US005234146A

United States Patent [19]

Meschi

[11] Patent Number: 5,234,146

[45] Date of Patent: Aug. 10, 1993

[54] COMPENSATION LOOP DEVICE FOR A WEB AND ITS OPERATION

[75] Inventor: Luciano Meschi, Livorno, Italy

[73] Assignee: Industria Grafica Meschi Srl., Livorno, Italy

[21] Appl. No.: 696,251

[22] Filed: Apr. 29, 1991

Related U.S. Application Data

[63] Continuation of Ser. No. 359,349, May 31, 1989, abandoned.

[30] Foreign Application Priority Data

Jun. 2, 1988 [IT] Italy ..... 20835 A/88

[51] Int. Cl.[5] ..... B65H 23/22

[52] U.S. Cl. ..... 226/43; 226/118; 400/578

[58] Field of Search ..... 226/42, 43, 45, 118; 242/182-184, 75.52; 400/578, 618; 101/248

[56] References Cited

U.S. PATENT DOCUMENTS

| | | | |
|---|---|---|---|
| 2,379,132 | 6/1964 | Cook | 242/75.52 X |
| 3,177,749 | 4/1965 | Best et al. | 226/42 X |
| 3,240,411 | 5/1966 | Zarleng | 226/42 |
| 3,250,480 | 5/1966 | Jacoby | 242/184 |
| 3,553,992 | 1/1971 | Harbaugh | 242/75.51 X |
| 3,600,562 | 8/1971 | Di Nicolantonio et al. | 242/75.51 X |
| 3,713,009 | 1/1973 | Poppinger et al. | 242/75.51 X |
| 3,784,071 | 1/1974 | Milan | 226/42 X |
| 4,057,185 | 11/1977 | Slama et al, | 226/42 X |
| 4,063,139 | 12/1977 | Miller | 242/184 X |
| 4,297,586 | 10/1981 | Rodgers | 226/42 X |
| 4,366,371 | 12/1982 | d'Alager de Costemore et al. | 242/75.51 X |
| 4,561,581 | 12/1985 | Kelly | 226/42 X |
| 4,848,634 | 7/1989 | Crowley et al. | 226/45 |

FOREIGN PATENT DOCUMENTS

| | | | |
|---|---|---|---|
| 2500396 | 7/1976 | Fed. Rep. of Germany . | |
| 2912656 | 10/1980 | Fed. Rep. of Germany . | |
| 0086542 | 5/1984 | Japan | 226/45 |

OTHER PUBLICATIONS

Patent Abstracts of Japan, vol. 10, No. 153 (M484), Jun. 3, 1986; and JP-A-61008367 (Fuji Shashin Film K.K.); Jan. 16, 1986.

Patent Abstracts of Japan, vol. 2, No. 103 (M78), Aug. 24, 1978; and JP-A-53-69722 (Nippon Denki K.K.); Jun. 21, 1978.

*Primary Examiner*—Daniel P. Stodola
*Assistant Examiner*—Paul T. Bowen
*Attorney, Agent, or Firm*—McAulay Fisher Nissen Goldberg & Kiel

[57] ABSTRACT

Compensation loop device between a web feed system and the input of the web in a paper using machine such as a high speed printer, for example, a laser printer, including a frame provided with sliding feeding rollers, the latter roller being driven by an electrical motor that accelerates or decelerates the web coming into the machine according to the length of a loop.

15 Claims, 2 Drawing Sheets

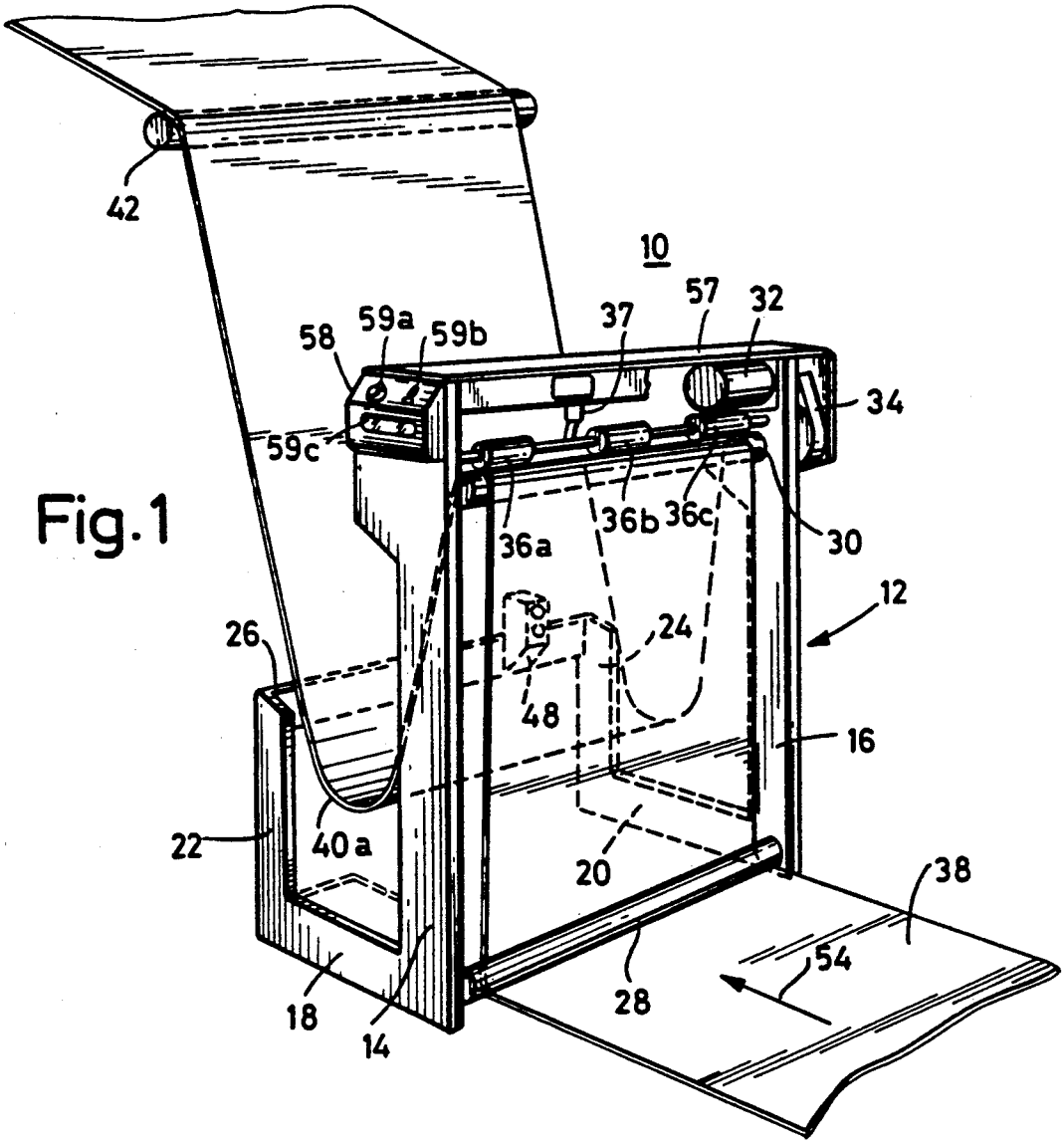
Fig.1
Fig.3
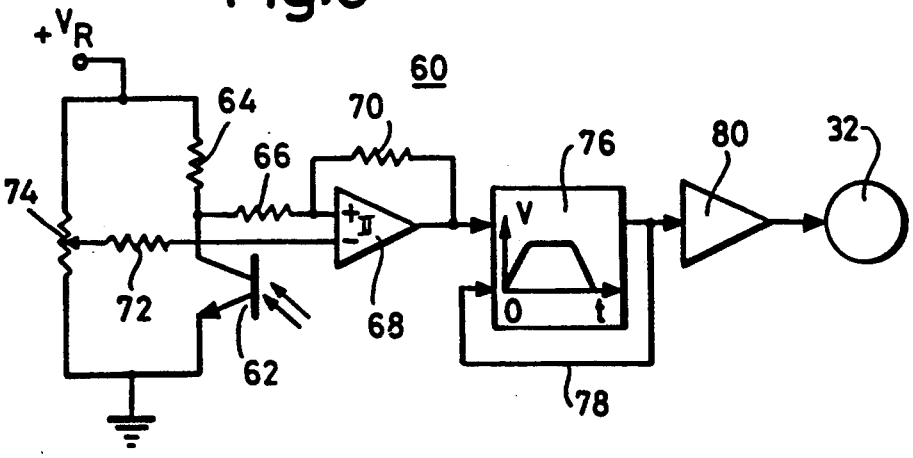

COMPENSATION LOOP DEVICE FOR A WEB AND ITS OPERATION

This application is a continuation of U.S. Ser. No. 07/359,349, filed May 31, 1989, now abandoned.

BACKGROUND OF THE INVENTION

1. Field of the Invention

The present invention relates to a device for generating a compensation loop on a web that is sent to graphic machines, such as printers.

2. Description of Related Art

In the graphic industry, there is often a problem of problem of providing a continuous web of printing paper coming from a supply, such as a reel or a box containing the web in a folded configuration, to a printer, wherein the printer may work in a intermittent way, while the web, even though it does not have to arrive in a continuous manner and at a constant rate to the printer, however it cannot be suddenly started or stopped in its running because it can be torn or jammed in an excessive quantity at the printer input, where sliding problems might arise.

Therefore, it is an object of the present invention to provide a device generating a loop in a web feeding a graphic machine, for compensating the intermittent operation of the graphic machine, because sometimes the web is not required and sometimes there is a strong necessity therefor.

Another object is to provide a signal capable of detecting the formation of a loop in a web at the input of the graphic machine. Another object is to stop the web letting in to the graphic machine when a loop formed in the device exceeds a first prefixed length and to start it again when the loop is shorter than a second prefixed length (that is its length is too short). A further object is to prevent the paper from being spoiled by causing stopping or starting of the movement of the web to take place in a gradual way.

A known method to signal an excessive shortening or lengthening of the loop is to employ very sensitive microswitches receptively connected both to a tray whereon the loop bottom can lay and to a short rod that can be lifted from the loop when the loop is shortening too much. The microswitches operate a motor controlling the entrance of the web to the graphic machine.

This method has the disadvantage of requiring very sensitive microswitches and consequently, the machine is readily disturbed by vibrations typical of these kinds of machines. Moreover, very weak microswitches can fail very often losing their operating and therefore the control of the web loop with consequences that can be easily understood.

Another method uses proximity detectors such as capacity detectors by which the capacity variation of an electrode as caused by the presence of an insulating material such as a web is sensed. These kind of detectors have a good strength and are relatively insensitive to vibrations, but they have a drawback of requiring frequent adjustments when the web composition changes or the environmental conditions change the moisture content of said web.

SUMMARY OF THE INVENTION

Shortly stated, the device of the present invention consists of a frame put between a storage or supply for paper to be printed and a graphic machine, such as a printer. The frame is provided with at least one roller driving a web that comes into the graphic machine after having formed a compensation loop. The roller is driven by a motor, the turning on of which depends on the detection of a prefixed length of the loop by a web presence detector. Particularly, the frame includes two rollers, on of which is idle and is used to take the web around another driving roller in turn driven by the motor (32) and helped in driving the web by counter-rollers which press the web against the roller.

According to a preferred embodiment of the present invention, the loop of the web is supported upstream by one driving roller and downstream by another driving roller that is part of the graphic machine receiving the web.

According to another preferred embodiment, the web presence detector is composed of a lamp and a photedector assembly by which the presence of the loop of the web in its proximity through the light reflected by the web is detected.

According to the last mentioned preferred embodiment, the photodector which detects the presence of the loop of the web, has a digital output, indicating the absence or the presence of the loop without considering small variations of the reflected light. Moreover, the photodector is equipped with an electronic circuit having a narrow hysteresis loop the output of which changes in a clear cut way as much as possible and without uncertainty from a high state to a low state respectively corresponding to the absence or presence of the web.

Particularly, the electronic circuit includes a voltage comparator comparing the output of the photedector with a voltage prefixed by a voltage regulator setting the electronic circuit to change its state at a prefixed distance between the photodector and the loop of the web giving place to a predetermined reflected light intensity.

In addition, in order to obtain a gradual acceleration up to a maximum speed of the motor of the driving roller and a gradual deceleration to a complete stop of the motor, the voltage comparator is followed by a ramp generator circuit by which the speed of said motor is adjusted varying it from a zero to a maximum value and back from the maximum value to zero in preset times permitting accelerations and decelerations of the motor in order not to spoil the paper web. The features and the advantages of the present invention will be better appreciated from the following description of an embodiment referred to the accompanying drawings, wherein:

BRIEF DESCRIPTION OF THE DRAWING

FIG. 1 is a partial perspective view of the compensation device according to the present invention.

FIG. 3 shows a simplified electronic circuit connecting a loop presence photodector with an electric motor for advancing a web.

DESCRIPTION OF THE PREFERRED EMBODIMENTS

Figure 2:
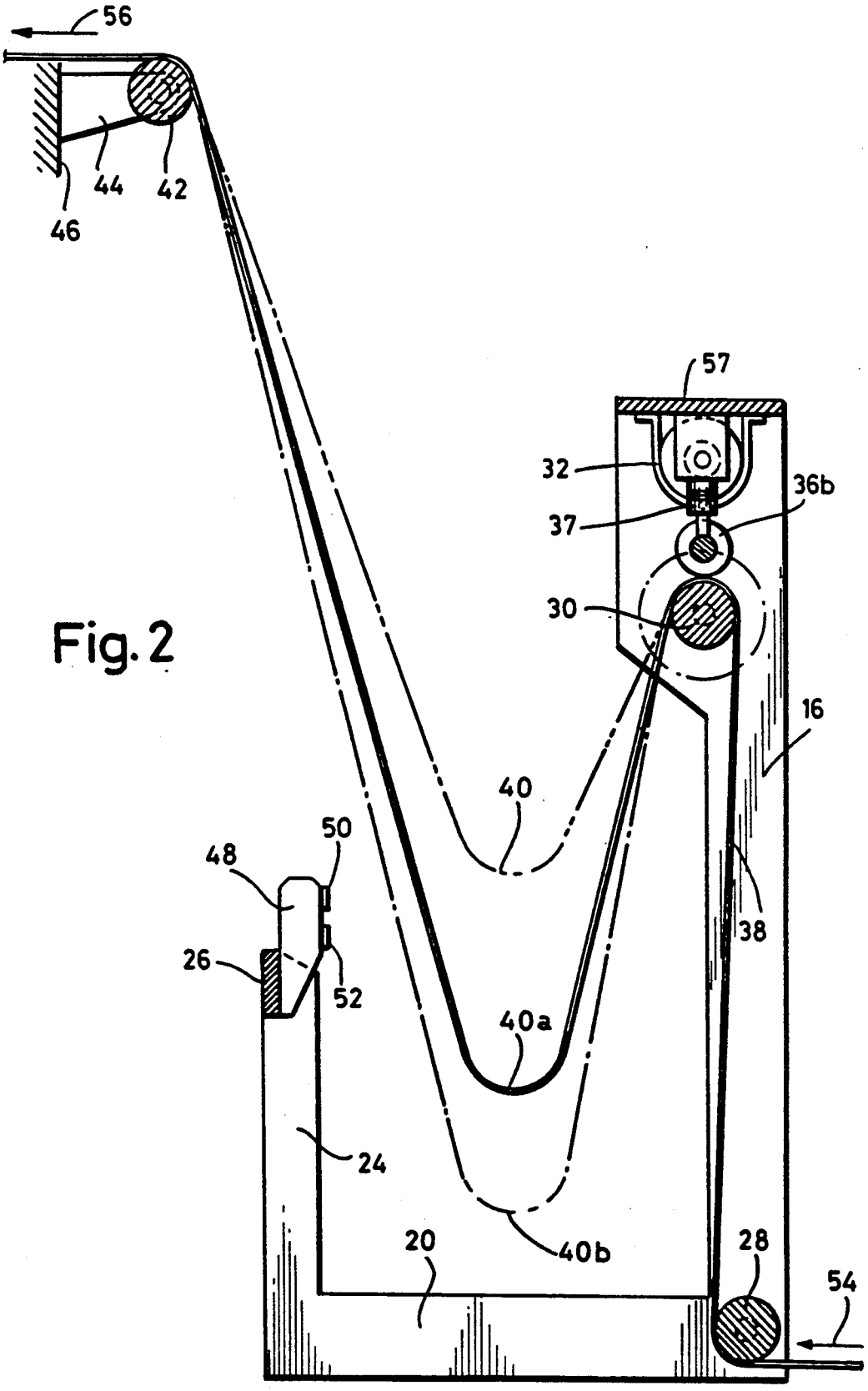
FIG. 2 is a side cutaway projection view of the device shown in FIG. 1.

Referring to the drawing and particularly to FIGS. 1 and 2, it can be seen that a compensation loop device 10 according to the present invention includes a frame 12 comprising two first vertical struts 14 and 16, two longitudinal horizontal members 18 and 20 attached to the base of the struts 14 and 16, two shorter vertical struts 22 and 24 and a cross member 26 connecting the shorter struts at their top. The top first vertical struts 14 and 16 support, in the lower part, a first roller 28 which is an idle roller and in the upper part, a second roller 30 which is a driver roller driven by an electric motor 32 by suitable means such as a belt 34. Supporting counterrollers 36*a*, 36*b*, 36*c*, keep pressed, by means of a paper device 37, a web 38 against a second roller 30 after it has passed around the idle or first roller 28, the web 28 coming from a paper storage, such as a reel or a box (not shown).

The web 38 after coming down from the roller 30 forms a loop 40 which during the operation can take positions 40*a* and 40*b* (see FIG. 2) and then comes up to another roller 42 fixed by brackets, such as a bracket 44 to the body (48) of a graphic machine.

The proper shape of the loop 40 is detected by a proximity detector consisting of a lamp or light emitter means 50 and of a photodector 52, sensing a light ray emitted by the lamp 50 and reflected or diffused by the loop 40 of the web 38 that is running in the direction of the arrows 54 and 56 (see FIG. 2).

The upper ends of the struts 14 and 16 are joined by a bridge 57, supporting the motor 32 and the device 37 by which the counterrollers 36*a*, 36*b*, 36*c* are placed against the roller 30 and one of the struts has a housing 58 for controlling circuits for the web 38 provided with knobs and displays 59*a*, 59*b* and 59*c*.

An electronic circuit for detecting the loop 40, as shown in FIG. 3, includes a phototransistor 62 connected by a load resistor 64 to a continuous input voltage $+V_R$ and by a coupling resistor 66 to a not inverting input of a voltage comparator circuit 68 that through a feedback resistor 70, whose value can be determined by a person skilled in the art, has a narrow hysteresis loop to promote a clear cut and definite change of its input state. The inverting input of the voltage comparator 68 is connected through a coupling resistor 72 to a potentiometer 74 whose adjustment influences the sensitiveness of the circuit 60 and therefore the distance between the loop 40 and the proximity detector 48 causing the state change at the output of the comparator 68.

The output of the comparator 68 is connected to an input of a ramp generator 76 that upon receiving at its input either an upwardly or a downwardly stepping signal for transforming the signal at the output in a ramp signal extending the time duration of its step variation. The ramp signal is taken to a second input by a feedback connection 78 to give linearity thereto and it is applied to an input of a driving amplifier 80 the purpose of which is to drive an electric motor, such as the motor 32, having a speed proportional to an applied voltage.

DESCRIPTION OF OPERATION

The operation of the present invention is as follows: a web 38 to be printed, is drawn from a storage and is passed around the rollers 28 and 30 of the frame 12 and then, after having formed the loop 40, comes to a roller 42 of the graphic machine.

The motor 32 rotates at its maximum speed driving the roller 30 and thus the web 38, the loop of which takes the positions 40, 40*a*, 40*b*. While the loop goes from the position 40 to the position 40*b*, the light reflected from the emitter 50 to the photodector 52 changes from an intensity almost zero to an increasing intensity, making the phototransistor of FIG. 3 more and more conductive until its collector voltage gets down to a value at which it commutates the output of the voltage comparator 68 from its high value to the low one. At that point the ramp detector 76 initiates a descending ramp at its output causing the motor 32 to gradually decelerate or slow down until it stops. Once the motor 32, is stopped the roller 42 keeps on drawing the web 48 in such a way that its loop goes from the position 40*b* to the position 40 where the lacking of light impinging onto the photodector 52 restores a high voltage at the output of the voltage generator 68 and a gradual return of high voltage according to a rising ramp at the output of the ramp generator 76. This in turn causes the motor to gradually accelerate or speed up again which, in turn, causes the web 38 to form again the loop passing from the position 40 to the position 40*b* and the operating cycle of the motor 32 is repeated.

If for any reason the graphic machine stops, the web 38 should never be drawn by the roller 42 and the loop would quickly extend below the position 40*b* causing the motor 32 to stop according to the characteristics of the ramp of the generator 76, thus ensuring the same web to stop gently. In the same way, the raising of the loop above the position 40 would cause the motor 32 to operate according to the characteristics of the ramp ensuring the restarting of the web 38 without being torn.

The hereinabove described embodiment is a preferred and not a limitating form of the present invention, and it is obvious that changes and substitutions with functionally equivalent elements for one or more components of the described device will lead to embodiments to be considered all within the scope of the invention.

For example, the ramp circuit 36 could be substituted for by a stepping function generator or by a microprocessor providing a series of numerical data that is above to provide gradual acceleration and deceleration control for the motor 32.

I claim:

1. A web compensation loop device for a web of flexible laser printing paper supplied from a paper supply means, including a storage and supply unit for the paper, to a laser printing machine having a variable printing speed for compensation for intermittent operation of the laser printing machine as a result of the variable printing speed thereof, comprising:

web means for supporting and moving said web positioned between said paper storage and supply unit and said printing machine for supporting one end of said web, and said printing machine including means supporting the other end of said web, said web means including means to move the paper in a direction from said paper supply means to said laser printing machine and for supporting said web therebetween, and said web forming a compensation loop as it leaves said web means and enters into said printing machine, said printing machine having an intermittent rate of feed thereto;

said moving means including roller means for driving the web to enter said printing machine with said compensation loop;

variable speed operative motor means carried by said means for driving said roller means in response to the intermittent operation of said printing machine;

a single detector means proximate to said web for transmitting rays thereto and responsive to reflections of the rays therefrom for detecting the presence of a predetermined length of said compensation loop and coupled with said variable speed operative motor means for controlling the speed thereof to provide a feed of the paper in accordance with the intermittent operation of said printing machine; and an electronic circuit for said presence detector means, said electronic circuit having a narrow hysteresis loop, the output of which sharply changes in a clear cut and definite way and without uncertainty from a high state to a low state, respectively, corresponding to the absence or presence of said loop;

wherein said electronic circuit comprises comparator means for producing a prefixed voltage for influencing the sensitivity of said electronic circuit, and voltage comparator means for comparing said prefixed voltage with the output of said presence detector means for setting said electronic circuit thereby to change its state at a prefixed distance between said presence detector means and the loop giving place to a predetermined reflected light intensity.

2. The web compensation loop device according to claim 1, wherein said roller means comprises:

a plurality of rollers, including a driving roller, counter-rollers and an idle roller, said idle roller serving to take said web around said driving roller, and said counter-rollers being associated with said driving roller for pressing said web there against for helping in driving said driving roller for moving said web; and said motor means being coupled with said driving roller for controlling the rotation thereof in response to the intermittent operation of said printing machine.

3. The compensation loop device of claim 2, wherein said laser printing machine includes a driver roller and a driving motor for said driver roller, and the web and the compensation loop being supported upstream by said driving roller and downstream by said driver roller.

4. A compensation loop device according to claim 2, wherein said presence detector means comprises a lamp for projecting a light onto said compensation loop and a photodetector assembly for detecting the presence in proximity of the loop of the web, said presence being detected in response to light reflected by the web itself.

5. The compensation loop device according to claim 2, wherein said presence detector means comprises a lamp for projecting light onto the loop of said web and a photodetector assembly for detecting the presence in its proximity of the loop of the web by detecting said presence through the light reflected by the web itself, said photodetector including a digital output responsive to detecting the absence or presence of said loop without considering small variations of said reflected light.

6. The compensation loop device according to claim 1, wherein said presence detector means is positioned between said laser printing machine and said web supporting means and comprises a lamp for projecting light onto the loop of said web and a photodetector assembly for detecting the presence in its proximity of the loop of the web by detecting said presence through the light reflected by the web itself, said photodetector including a digital output responsive to detecting the absence or presence of said loop without considering small variations of said reflecting light.

7. The compensation loop device according to claim 6, wherein said comparator means is a potentiometer.

8. The compensation loop device according to claim 6, including:

ramp generator circuit means for adjusting the speed of said motor means in order to obtain a gradual acceleration up to the maximum speed of said motor means for said driving roller and a gradual deceleration to a minimum speed of said motor means;

said voltage comparator being followed by said ramp generator circuit for varying the speed of said motor means from a minimum value to a maximum value and back from the maximum value to the minimum value in prefixed times permitting accelerations and decelerations of said motor means such as not to spoil the web.

9. The compensation loop device according to claim 6, including ramp generator circuit means for adjusting the speed of said motor means in order to obtain a gradual acceleration up to the maximum speed of said motor means for said driving roller and a gradual deceleration to a minimum speed of said motor means.

10. The compensation loop device according to claim 9, including roller comparator means for comparing the output of said photodetector with a voltage, said voltage comparator means being followed by said ramp generator circuit for varying the speed of said motor means from zero to a maximum value and back from the maximum value to zero in prefixed times permitting accelerations and decelerations of said motor means such as not to spoil the web.

11. The compensation loop device according to claim 1, wherein said variable speed motor means is a voltage controlled motor having a rotational speed proportional to the supply voltage.

12. The compensation loop device of claim 1, wherein said laser printing machine includes a driver roller and a driving motor for driving said driver roller, said roller means includes a driving roller supported by said web supporting and moving means, and the web loop being supported upstream by said driving roller and downstream by said driver roller.

13. The compensation loop device according to claim 1, wherein said presence detecting means includes a digital output responsive to the absence or presence of said loop without considering small variations of reflected light.

14. The compensation loop device of claim 1, wherein said web supporting and moving means includes a frame.

15. The compensation loop device according to claim 1, wherein said presence detector means comprises a lamp for projecting light onto the loop of said web and a photodetector assembly for detecting the presence in its proximity of the loop of the web by detecting said presence through the light reflected by the web itself, said photodetector including a digital output responsive to detecting the absence or presence of said loop without considering small variations of said reflected light.

* * * * *